United States Patent [19]

Liska

[11] Patent Number: 4,775,303

[45] Date of Patent: Oct. 4, 1988

[54] PUMP HAVING ADJUSTABLE PACKING

[76] Inventor: Miroslav Liska, 1242 Holt St., Los Angeles, Calif. 90035

[21] Appl. No.: 699,680

[22] Filed: Feb. 8, 1985

[51] Int. Cl.[4] ..... F04B 21/04; F16T 15/18

[52] U.S. Cl. ..... 417/554; 92/168; 277/64; 277/106

[58] Field of Search ..... 92/168; 417/554; 277/62, 64, 106

[56] References Cited

U.S. PATENT DOCUMENTS

| | | | |
|---|---|---|---|
| 1,281,412 | 10/1918 | Parsons | 97/168 |
| 1,384,097 | 7/1921 | Schlacks | 277/62 |
| 1,590,849 | 6/1926 | Nilson | 277/62 |
| 2,192,325 | 3/1940 | Nilson | 277/62 |
| 3,251,602 | 5/1966 | Williams et al. | 277/62 |
| 4,277,229 | 7/1981 | Pacht | 417/539 |
| 4,299,395 | 11/1981 | Reed | 277/64 |

*Primary Examiner*—William L. Freeh

*Attorney, Agent, or Firm*—Harlan P. Huebner

[57] ABSTRACT

This invention relates to an improvement in a reciprocating piston type pump having spaced radially expanding packings which are expandable in response to axial pressure on the packings. There is also included a compression spring between the packings. The pump contains means to vary the compression of the compression spring dependent upon the pressures within the pump during operation.

4 Claims, 4 Drawing Sheets

PUMP HAVING ADJUSTABLE PACKING

BACKGROUND OF THE INVENTION

1. Field of the Invention

The present invention relates to an improvement in pumps and more particularly to those of the reciprocating piston type having radially contained packing with axially acting follower means for expanding it. Such pumps generally are applied to a variety of uses, for example to supply slurries of paint or other coating compositions to spray heads, liquid transfers and fluid injection such as is required in the petroleum industry.

2. Description of the Prior Art

Pumps of the type with which the present invention is concerned produce a discharge of fluid under pressure during reciprocatory movements of the piston in both directions. The initial suction stroke of the piston inducts fluid past a check valve into one chamber and the subsequent movement of the piston in the opposite direction transfers that liquid past a piston check valve through a smaller second chamber and out through a discharge port. The next suction stroke of the piston, in addition to inducting fluid into the first chamber as described above, decreases the volume of the second chamber forcing fluid in it out through the discharge port. An expansible packing surrounds the piston between the two chambers and a second expansible packing surrounds the piston rod adjacent the opposite end of the second chamber.

In the known Wagner pump a spring is compressed between these two packings exerting axial pressure sufficient to expand them into sealing engagement with the piston and piston rod and the surrounding casings. The force exerted by such a spring is not capable of being altered without disassembly of the pump and replacement of the spring.

The pressures under which slurries are to be discharged from such pumps vary from as high as 4000 lbs./in$^2$ depending upon the viscosity of the slurry, the finish to be imparted to the work piece, and other factors. In order to avoid excessive wear on the piston, piston rod and surrounding casing, it is desirable to decrease the axial pressure exerted by such a spring when low discharge pressures are desired as in the case of relatively thin slurries and to increase such pressure only when high discharge pressures are required as in the case of viscous slurries, or a different spray arrangement to be employed requires various (high or low) pressures.

SUMMARY OF THE INVENTION

According to the present invention means are provided for varying the compression of a spring disposed between the packings of such a pump by adjustment of an element which is accessible exteriorly of the pump.

This is accomplished by disposing a sleeve which is axially movable within the casing between a first packing fixed in position within the pump casing and a compression spring the opposite end of which acts against a second packing compressed between the spring and an adjusting member in threaded engagement with the casing and accessible exteriorly of the pump casing.

This arrangement is such that, by rotation of the exteriorly accessible adjusting member the compression of the spring may be increased or decreased and the axial pressure against both packings varied accordingly.

DESCRIPTION OF THE PREFERRED EMBODIMENT

Figure 1:
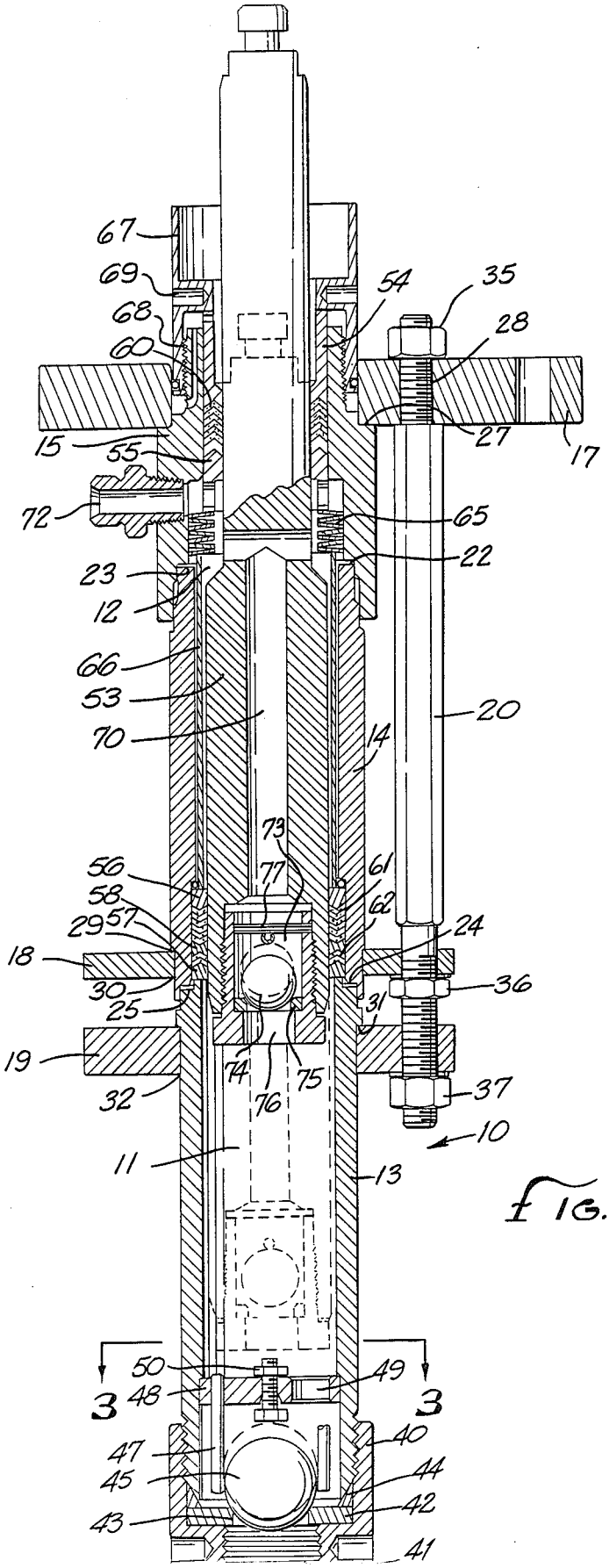
FIG. 1 is a view in longitudinal section of a pump embodying the present invention.
Figure 2:
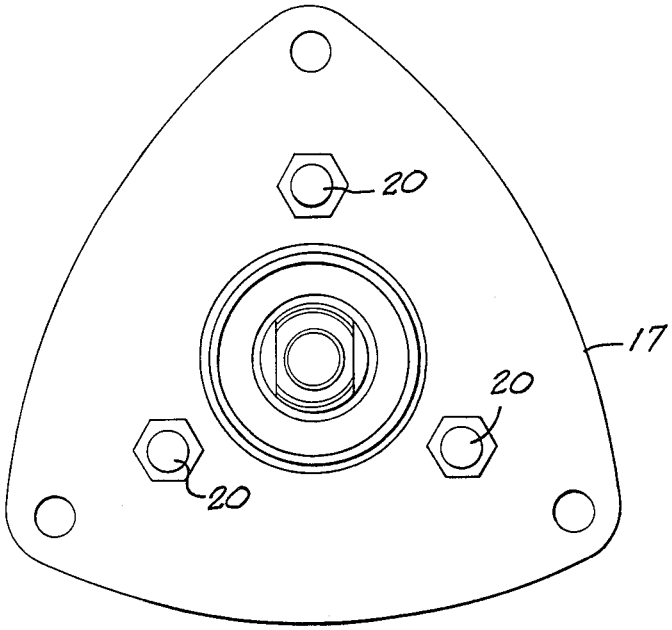
FIG. 2 is a view in end elevation of the pump of FIG. 1 as viewed from the left of FIG. 1.

As shown in the accompanying drawings, the pump of the present invention comprises a metal cylinder 10 enclosing an inlet chamber 11 and a discharge chamber 12. The cylinder 10 is made up of a tubular lower section 13, a tubular upper section 14, and a cap 15.

These two sections and the cap are held together in axial alignment by an assembly comprising an upper plate 17, an intermediate plate 18, and a lower plate 19 connected by tie rods 20 passing through openings in the cap and plates as shown.

Cap 15 has an internal shoulder 22 which provides a seat for a cap seal 23 compressible between the cap 15 and the upper end of the upper cylinder section 14, and at its opposite end the section 14 is provided with an internal shoulder 24 which provides a seat for a cylinder seal 25 compressible between the upper cylinder section 14 and the upper end of the lower cylinder section 13.

A shoulder 27 of cap 15 engages the margin of an opening 28 in upper plate 17, a shoulder 29 of upper section 14 engages the margin of an opening 30 in intermediate plate 18, and a shoulder 31 of lower section 13 engages the margin of an opening 32 in lower plate 19. Nuts 35 threaded on tie rods 20 engage one side of upper plate 17 while nuts 36, also threaded on tie rods 20, engage the opposite side of intermediate plate 18 and nuts 37, also threaded on tie rods 20, engage the corresponding side of lower plate 19. Thus, by tightening nuts 36 the cap seal 23 may be compressed to seal the joint between the cap 15 and the upper section 14; by tightening nuts 37 the cylinder seal 25 may be compressed to seal the joint between the upper and lower sections 13 and 14.

Figure 3:
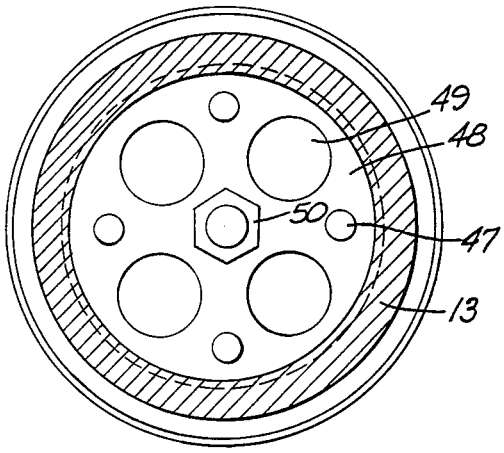
FIG. 3 is a view in transverse cross-section of the pump taken on the line 3—3 of FIG. 1.
Figure 4:
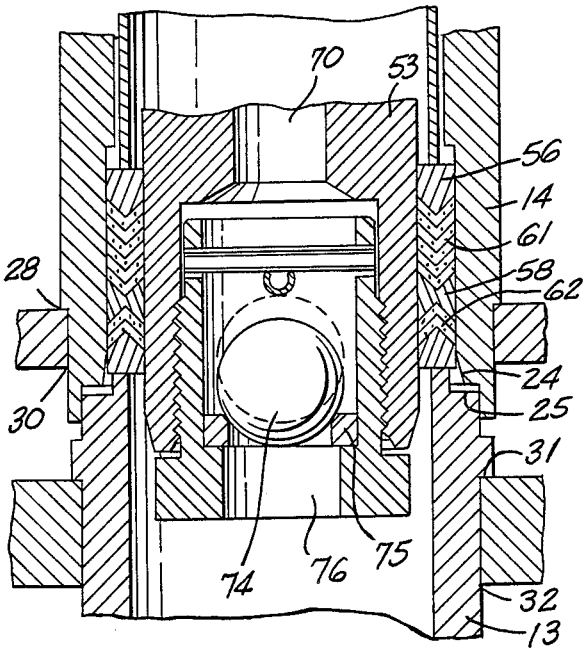
FIG. 4 is a detail view in transverse section of the piston check valve portion of the pump.
Figure 5:
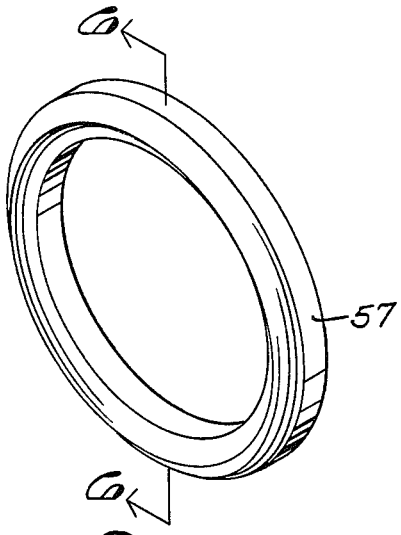
FIG. 5 is a view in perspective of a male adaptor employed in compressing the pump packing.
Figure 6:
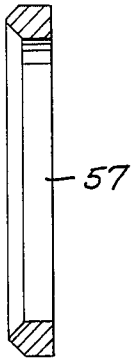
FIG. 6 is a view in section taken on the line 6—6 of FIG. 5.
Figure 7:
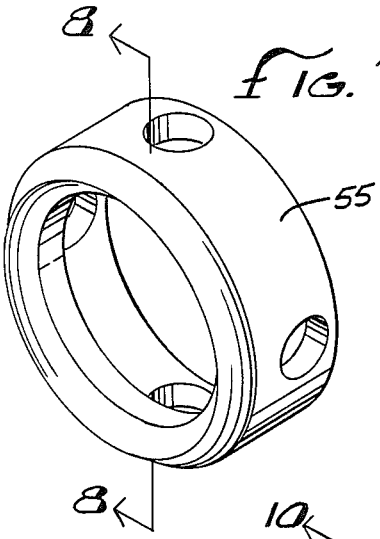
FIG. 7 is a view in perspective of another male adaptor employed in compressing the pump packing.
Figure 8:
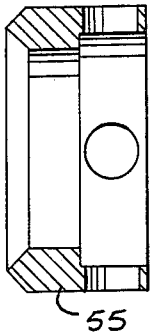
FIG. 8 is a view in section taken on the line 8—8 of FIG. 7.
Figure 9:
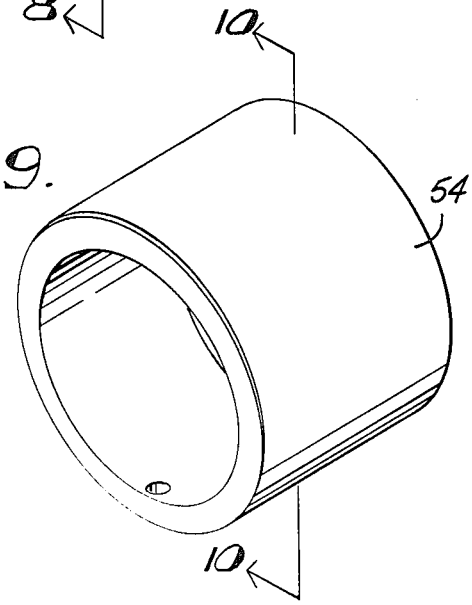
FIG. 9 is a view in perspective of a female adaptor employed in compressing the pump packing.
Figure 10:
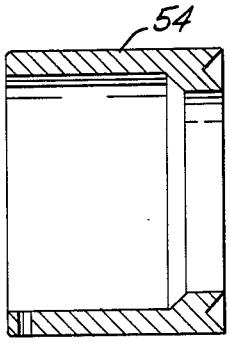
FIG. 10 is a view in section taken on the line 10—10 of FIG. 9.

The inlet chamber 11 is provided at its open end with check valve means which permit the induction of fluid into the chamber through the lower end thereof, but do not permit its discharge through that end. For this purpose there is threaded onto the open end of the lower section 13 an inlet cap 40 having an inlet opening 41. An inlet valve seat 42 having an opening 43 and a seal 44 are held in position against the open end of the lower cylinder section 13 by the inlet cap 40. A check ball 45 is caged for limited movement adjacent the opening 43 by pins 47 anchored in a disc 48 frictionally retained within the inlet chamber 11 and apertured as at 49. See also FIG. 3. A nut and bolt assembly 50 frictionally retained in the disc 48 centrally thereof may be adjusted to vary the amount of movement permitted ball 45.

A piston 53 is reciprocably mounted within the cylinder 10, guided adjacent its upper end by a female adaptor 54 and a male adaptor 55, both axially slidable within the cap 15. The piston is guided adjacent its lower end by male adaptors 56 and 57 and female adaptor 58 slidable within the upper section 14, but with downward movement of adaptor 57 limited by the abutting end of lower section 13.

Figure 12:
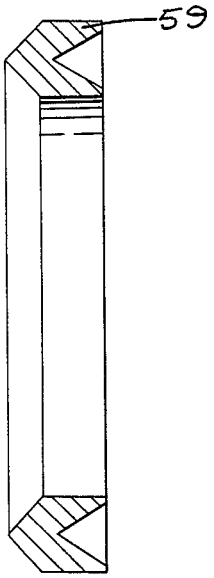
FIG. 12 is a view in section taken on the line 12—12 of FIG. 11.
Figure 11:
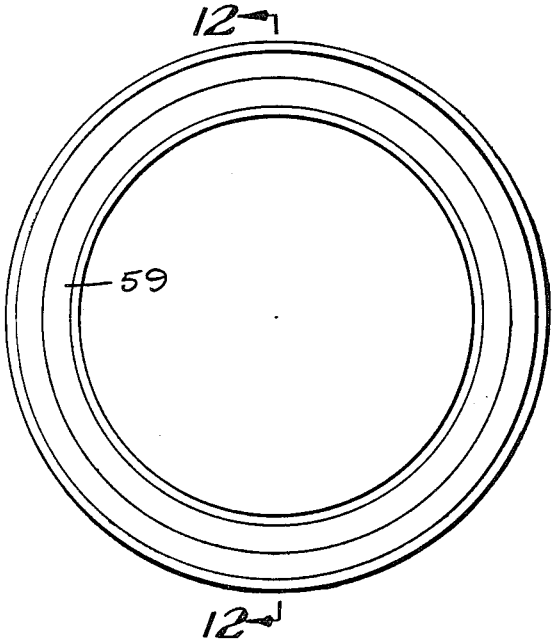
FIG. 11 is a view in elevation of one of the series of rings forming the piston seals.
Figure 13:
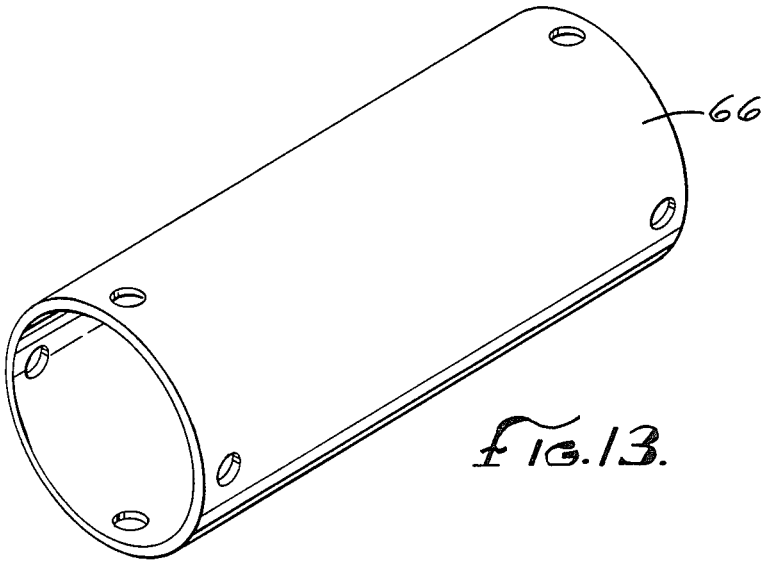
FIG. 13 is a detail view in perspective of the seal pressure equalizing tube.

Packing means radially expansible in response to axial pressure surround the piston 53 between the adaptors 54 and 55, between the adaptors 57 and 58 and between the adaptors 56 and 58. These packing means comprise three series of packing rings 59 (FIGS. 11 and 12) of chevron configuration and of alternate flexible leather and Teflon forming an upper seal 60 and lower seals 61 and 62.

Means are provided for exerting an axial pressure on the packing means to expand the rings 59 into sealing engagement with the piston 53 and the interior wall of the cylinder 10 comprising a plurality of compression springs 65 compressed between the upper adaptor 55 and an axially movable tube 66 which at its opposite end bears against the adaptor 56.

Means including an element in the form of a collar 67 threaded onto the exterior of the cap 15 exteriorly of the casing 10 as at 68 are provided for varying the magnitude of the compression of the springs 65 and thus varying the axial pressure exerted on the seals 60, 61 and 62; sockets 69 being provided in the collar 67 for the insertion of a tool for its rotational adjustment.

The piston 53 has a central passage 70 opening at its upper end into the discharge chamber 12 which is connected to a discharge port 72. At its lower end the central passage 70 opens into a valve chamber 73 containing a check ball 74 and seat 75 controlling a passage 76 in the piston 53 communicating between the inlet chamber and the central passage 70 of the piston 53; a cross-pin 77 limiting movement of ball 74.

In operation, the collar 67 is preset by rotating it with respect to the cap 15 so as to vary the compression of springs 65 according to the magnitude of the pressure under which fluid is to be discharged from the pump; the compression of the spring being increased as the pressure to be developed is increased and/or any adjustment required because of packing wear.

During the initial suction stroke of the piston 53, fluid is drawn into the inlet chamber 11 through the inlet opening 41 which is immersed in the fluid to be pumped. Then, during the discharge stroke of the piston, the fluid drawn into the chamber 11 is transferred through the central passage 70 of the piston into the discharge chamber 2. Thereafter during suction strokes fluid in the discharge chamber 12 is discharged through the discharge port 72 as fluid is being drawn into the inlet chamber 11 and during discharge strokes fluid is discharged from inlet chamber 11 through the passage 70 and port 72.

I claim:

1. In a pump of the character described having inlet and discharge chambers, a piston reciprocable within said chambers spaced packings radially expansible in response to axial pressure surrounding said piston, and means for exerting axial pressure on said packings including a compressible spring between said packings; the improvement comprising means including an element engageable exteriorly of said pump without diassembly thereof to vary the compression of said spring.

2. In a pump of the character described having a cylindrical body, a piston reciprocable within said body, a plurality of spaced packings radially expansible in response to axial pressure surrounding said piston and engaging the interior wall of said cylindrical body, and means for exerting axial pressure on said packings including means including a compressible spring between said packings for exerting axial pressure on said packings; the improvement comprising a cylindrical collar carried by said cylindrical body exteriorly thereof and axially adjustable with respect thereto, and means for transmitting axial movement of said collar to said spring to adjustably vary the compression thereof; whereby equal variable axial pressures are exerted upon both said spaced packings.

3. The improvement in a pump according to claim 2 in which said collar is coaxial with said cyindrical body, threaded thereon for axial adjustment with respect thereto, and extends beyond one end of said cylindrical body.

4. The improvement in a pump according to claim 3 in which said axial movement transmitting means comprises a sleeve axially movable within said cylindrical body between said collar and said packings.

* * * * *